United States Patent [19]

Eguchi

[11] Patent Number: 4,947,995

[45] Date of Patent: Aug. 14, 1990

[54] COIN INLET

[75] Inventor: Norio Eguchi, Oyama, Japan

[73] Assignee: Universal Co., Ltd., Tochigi Prefecture, Japan

[21] Appl. No.: 321,288

[22] Filed: Mar. 9, 1989

[30] Foreign Application Priority Data

Mar. 30, 1988 [JP] Japan ..... 63-42243[U]

[51] Int. Cl.[5] ..... A47F 7/00

[52] U.S. Cl. ..... 211/49.1; 194/344

[58] Field of Search ..... 211/49.1, 59.2, 86, 211/126, 50, 13; 194/344; 453/61, 62; 206/0.81; 232/1 D

[56] References Cited

U.S. PATENT DOCUMENTS

| | | | |
|---|---|---|---|
| 683,280 | 9/1901 | Hofheimer | 194/344 X |
| 811,197 | 1/1906 | Brandt | 211/49.1 |
| 888,539 | 5/1908 | Simpson | 211/59.2 |
| 961,832 | 6/1910 | Ayres | 453/62 X |
| 1,115,661 | 11/1914 | Goetz | 194/344 X |
| 1,212,521 | 1/1917 | Lonson | 211/49.1 |
| 1,217,170 | 2/1917 | Grover | 194/344 X |
| 2,249,005 | 7/1941 | Karns | 211/49.1 X |
| 2,562,180 | 7/1951 | Foley et al. | 206/0.81 X |
| 2,588,618 | 3/1952 | Di Renzo | 211/59.2 X |
| 4,109,668 | 8/1978 | Malacheski | 211/49.1 X |
| 4,494,658 | 1/1985 | Simon et al. | 211/49.1 |

*Primary Examiner*—Alvin C. Chin-Shue
*Assistant Examiner*—Sarah A. Lechok
*Attorney, Agent, or Firm*—Staas & Halsey

[57] ABSTRACT

A coin inlet in which a storing recess capable of accommodating a plurality of coins in the state of being piled up is disposed parallel to a slot for inserting coins one by one so as to move the coins accommodated in the storing recess to the slot.

3 Claims, 3 Drawing Sheets

COIN INLET

BACKGROUND OF THE INVENTION

1. Field of the Invention

The present invention relates to a coin inlet for an automat, an exchanger, a game machine using coin-shaped medals such as a slot machine, or the like, through which a coin or a medal (hereinafter, referred to inclusively as a coin) is supplied.

2. Related Art

In a conventional coin inlet, coins are inserted one by one into a slot or slit having a length and a width slightly greater than the diameter and width, respectively, of the coin. Such a coin inlet, shown in FIG. 5, is typically used in the case where coin insertion is repeated many times, such as for a slot machine. In this coin inlet, a slot 3 is formed in the front side of a back plate 2 extending upwardly from a base 1 so as to insert coins one by one into the slot 3 along the back plate 2. The coin inlet is attached to a slot machine or the like by placing the lower part of the base 1 in an opening formed in the front face of the slot machine or the like and attaching it with suitable means, such as threaded fasteners. Moreover, the base 1 has a push button 4 for discharging clogged coins.

However, when a plurality of coins are continuously inserted into such a conventional coin inlet, a player has to have coins in one hand and insert coins one by one into the inlet by another hand, thus requiring the use of both hands. Otherwise it is necessary to carry out coin holding and coin inserting action at the same time by single hand. Coin insertion is difficult, and coins held in the hand are sometimes dropped onto the floor. For example, in the case of a slot machine, it is necessary to insert three coins per game, and in the case of, a game called "credit", up to 50 coins can be inserted. This multiple coin inserting action creates troublesome and wearisome problems for the players.

In order to solve these problem, there has been proposed a device in which a coin storing chamber is disposed in the body of the slot machine so as to accommodate a large number of coins. A continuous supply can be realized by operation of a button disposed on the front face of the body. However, because the coin storing chamber of this device is disposed in the slot machine, it is difficult to attach this device in an existing machine. Also, when the machine is designed and manufactured, there is a problem related to production cost due to the additional structure necessary for inserting coins by button operation, taking out unused coins and the like.

SUMMARY OF THE INVENTION

An object of the present invention is to provide a coin inlet having a simple structure by which coins can be continuously inserted with ease.

According to the present invention, there is provided a coin inlet characterized in that a storing recess capable of accommodating a plurality of coins in a roll or stack wherein the coin faces are longitudinally aligned at an incline to a slot for inserting coins one by one so as to move the coins accommodated in the storing recess to the slot.

The storing recess is preferably inclined so that lower side may be lower than the position of the slot.

When a plurality of coins accommodated in the storing recess are pushed to the slot by a finger, the coins are introduced into the slot from the top coin in order, and fall through a coin path disposed under the slot. By continuing this pushing action, the coins fall from the slot one after another and are supplied continuously. In order to stop the coin supply, the pushing action is simply stopped.

When the storing recess is inclined so that the lower side may be lower than the position of the slot, the coins accommodated in the storing recess are positioned in one side unless the coins are pushed by a finger. When the coins are pushed toward the slot along the storing recess, the coins can be moved without the top coin falling down. When the pushing action is stopped, the remaining coins return to the position of the lower side along the storing recess.

DETAILED DESCRIPTION OF THE PREFERRED EMBODIMENT OF THE INVENTION

Figure 1:
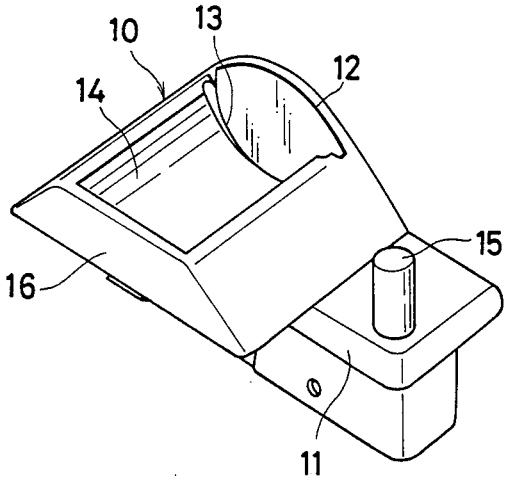
FIG. 1 is a perspective view showing an embodiment of the present invention.
Figure 2:
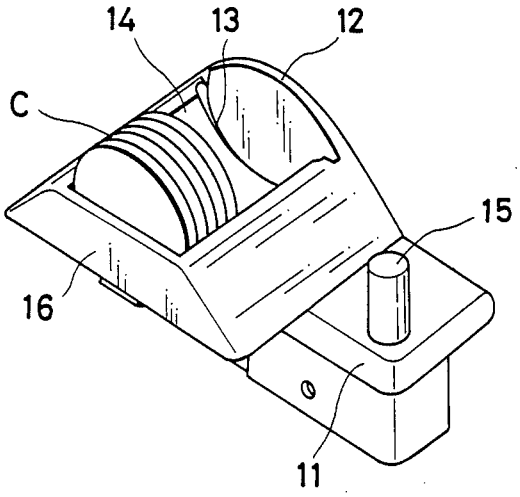
FIG. 2 is a perspective view showing the state where coins are placed in order in the storing recess of the embodiment of FIG. 1.

FIG. 1 shows a preferable embodiment of the present invention. A coin inlet 10 has an elongated slot 13 having a curved sidewall, an open top, a first end wall 16 and a second end wall formed by a back plate 12. Coins are inserted through the slot, which is disposed in front side of the back plate 12 which extends upwardly from a base 11. A storing recess 14 having a semicircular cross section is disposed in front of the slot 13. The storing recess 14 is formed so as to accommodate a plurality of coins in a stack at an incline to the slot 13 as shown in FIG. 2. In the same manner as in the conventional example of FIG. 5, a push button 15 for solving coin clogging is provided at one end of the base 11.

When coins are supplied, all coins are moved toward the slot 13 by pushing the coins accommodated in the storing recess 14. As a result, the coins are introduced into the slot 13 one after another from the top coin.

Figure 3:
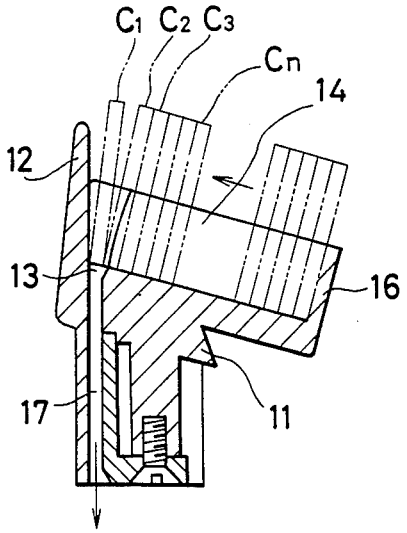
FIG. 3 is a vertical sectional view of the embodiment.

In this embodiment, as shown in FIG. 3, the storing recess 14 is inclined so that one side is lower than the position of the slot 13. Consequently, the coins accommodated in the storing recess 14 are positioned in the lower side by being supported by a front recess wall 16 unless pushed by a finger. When a plurality of coins $C_1$ to $C_n$ are placed in a roll or stack, the last coin $C_n$ in contact with the recess wall 16 is pushed toward the slot 13 by a finger. All the coins are thus moved along the storing recess 14 without falling down. The top coin $C_1$ abuts the back plate 12 and simultaneously falls through the slot 13 into a coin path 17 formed under the slot 13. This coin path is in communication with the inside of a machine such as a slot machine or the like attached with this coin inlet.

By continuing the finger action, successive coins $C_2$, $C_3$, . . . fall through the slot 13 one after another, whereby the coins are continueously supplied. When it is desired to stop the coin supply, the finger action is simply stopped, and the remaining coins return to the position of the lower side.

Figure 5:
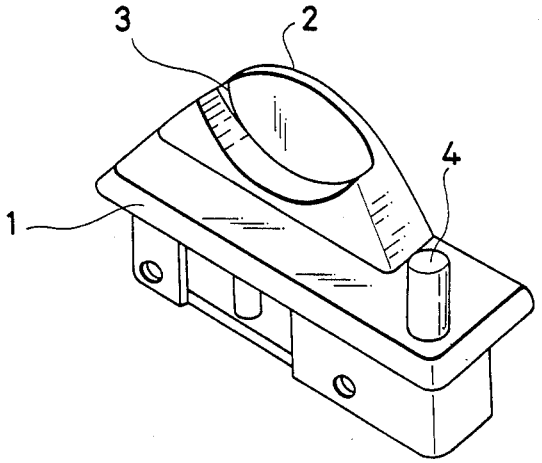
FIG.5 PRIOR ART
FIG. 5 is a perspective view showing a conventional coin inlet.
Figure 4:
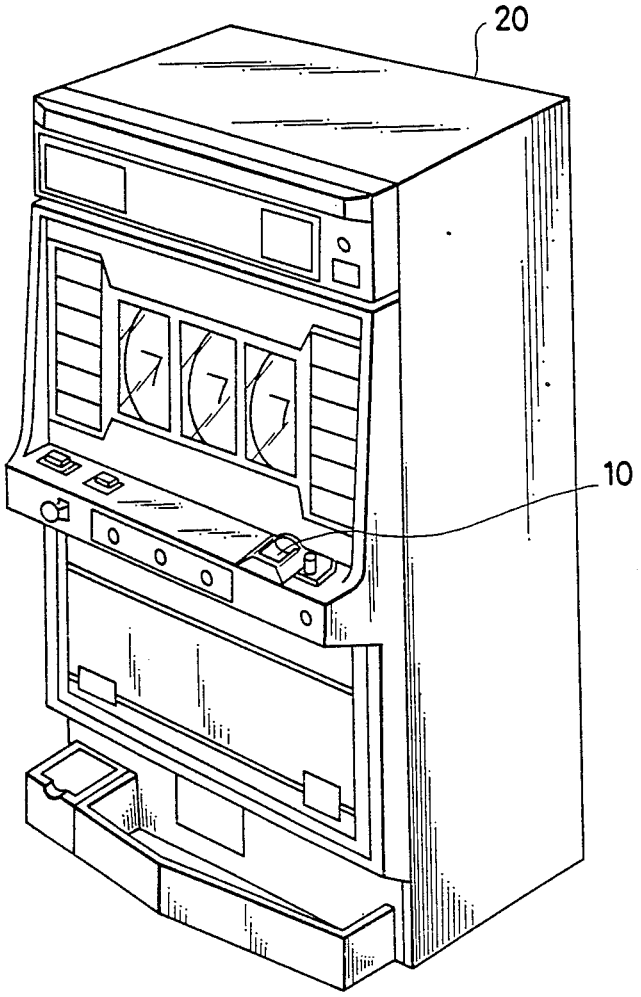
FIG. 4 is a perspective view of the front side of a slot machine attached with the embodiment of the FIG. 1.

The coin inlet 10 is attached on the front face of a slot machine 20 as shown in FIG. 4 in the same manner as in the conventional example of FIG. 5. That is, the lower part of the base 11 is put in an opening previously formed in the front face of the slot machine 20 and fixed by screwing down.

Although the storing recess 14 is formed as one body with the base 11 and the back plate 12 in this embodiment, the portion forming the storing recess 14 may be formed as a separated part from the other portions and combined with a conventional coin inlet (for example, of FIG. 5) which has only a slot through which coins can be inserted one by one, whereby a coin inlet having the same function as the above embodiment can be realized.

Though the embodiment mentioned above has been explained as used for a slot machine, the present invention can also be used for other amusement machines, automats, public telephones, etc. as well as slot machines.

As mentioned above, since the coin inlet of the present invention has a storing recess capable of accommodating a plurality of coins in order in a stack at an incline to the slot so as to move the coins accommodated in the storing recess toward the slot, it has a simple structure and exhibits such an effect that coin storing and continuous supply can be achieved with ease and certainty.

What is claimed is:

1. A coin inlet comprising an elongated storing recess capable of accommodating a plurality of coins in a stack wherein the coin faces are longitudinally aligned at an incline to a slot for inserting coins one by one, the storing recess having a lower end against which the last coin of the stack rests prior to pushing the stack towards the slot and an upper end adjacent the slot.

2. A coin inlet according to claim 1, wherein the storing recess has an open top, a curved sidewall, a lower end wall, and an upper end wall, the upper end wall being formed by a backing plate of the slot.

3. A coin inlet according to claim 1, wherein the recess has a width of about a diameter of the coin, a length of greater than the total thickness of the plurality of coins, and a depth of less than the diameter of the coins.

* * * * *